United States Patent [19]

Greene

[11] Patent Number: 4,658,703

[45] Date of Patent: Apr. 21, 1987

[54] METHOD AND APPARATUS FOR EXTRACTING HEAT AND MECHANICAL ENERGY FROM A PRESSURED GAS

[75] Inventor: David R. Greene, Bakersfield, Calif.

[73] Assignee: Centrifugal Piston Expander, Inc., San Antonio, Tex.

[21] Appl. No.: 717,776

[22] Filed: Mar. 29, 1985

[51] Int. Cl.[4] ..... F01B 1/00; F01B 7/00

[52] U.S. Cl. ..... 91/170 R; 91/476; 91/176; 60/374; 60/484

[58] Field of Search ..... 91/170, 174, 176, 183, 91/191, 411 R, 303, 339; 60/516, 374, 483, 484

[56] References Cited

U.S. PATENT DOCUMENTS

| | | | |
|---|---|---|---|
| 1,292,171 | 11/1923 | Walk . | |
| 1,529,111 | 3/1925 | Bowman | 91/476 X |
| 2,441,797 | 5/1948 | Carnahan | 91/176 X |
| 3,220,316 | 11/1965 | Kummerman | 91/176 |
| 4,066,003 | 1/1978 | Alde, Sr. | 91/170 R |

*Primary Examiner*—Larry Jones

*Attorney, Agent, or Firm*—Norvell & Associates

[57] ABSTRACT

A piston type expander/prime mover utilizes a plurality of pairs of cylinders mounted on a rotatable cylinder support. Each cylinder has an open end and a closed end and each pair of cylinders has their open ends disposed in spaced, opposed relationship. A pair of pistons respectively cooperate with the pair of cylinders, and each piston has a connecting rod pivotally secured thereto and projecting through the open end of the respective cylinder. The two ends of the connecting rods are in turn pivotally connected to a lever arm which is secured to the movable element of a first unidirectional (over-running) clutch which has its stationary element secured to a stationary shaft. A first load transmitting element is secured to the rotatable element of the unidirectional (over-running) clutch. Valving is provided in the closed end of each cylinder to permit a charge of pressured gas to be introduced into such closed end as the respective piston approaches such closed end. As a result, half of the pistons advance through a power stroke, rotating the first load transmitting member through an arcuate angle and the cylinders are then moved on the next power stroke in the same direction to effect the return of the first half of the pistons to the other ends of the cylinders and thus drive the second load transmitting element in the same direction as the first load transmitting element, but completely independent thereof.

2 Claims, 8 Drawing Figures

METHOD AND APPARATUS FOR EXTRACTING HEAT AND MECHANICAL ENERGY FROM A PRESSURED GAS

BACKGROUND OF THE INVENTION

1. Field of the Invention

This invention relates to an expander/prime mover for extracting heat and mechanical energy from a pressured gas, particularly to a piston type expander having dual, independent rotatable mechanical outputs.

2. Description of the Prior Art

The great majority of rotary engines designed for operation by a pressured gas have utilized linearly reciprocating pistons and cylinders. Similarly, many expanders have resorted to the use of linearly reciprocating pistons and cylinders. In most instances known to Applicant, the pistons have been connected to a crankshaft and in this manner, the reciprocating movements of all the pistons produced by expansion of a pressured gas in the cylinders is converted into a rotational power output, while the gas is concurrently cooled.

The utilization of a crankshaft inherently involves expensive precision manufacturing operations in order to ensure the balance of the crankshaft. Additionally, the successive power strokes of each piston are delayed by an interval determined by the rotational speed of the crankshaft, since this determines the time required for the piston to return from its bottom dead center position to its top dead center position in its respective cylinder. For this reason, the utilization of fluid pressure engines is primarily confined to low torque, high speed applications. It inherently does not have the ability to generate a substantial torque at low speeds due to the substantial delay in the successive expansions of the pressured gas charges supplied to each cylinder. Additionally, there is the well known deficiency involved in every crankshaft of the effective moment arm of the piston force varying cyclically from zero to a maximum and then back to zero as the piston proceeds through its entire power stroke.

In co-pending application Ser. No. 634,846, filed July 26, 1984 and assigned to the assignee of this application, there is disclosed an apparatus for producing a mechanical rotating output by expansion of a pressured gas in a plurality of cylinders arranged on a circular support in an equally spaced array about the axis of a rotatable shaft to which the cylinder support is secured. The pistons cooperating with the cylinders are secured to one rotary element of a unidirectional (over-running) clutch which is constructed so that movement of the pistons in one direction relative to the cylinders is prevented while movement of the pistons in the opposite direction is permitted. A load driving element is connected to the rotatable shaft on which the cylinders are mounted and hence an intermittent rotational power output is provided by such shaft due to the reaction forces intermittently acting on the cylinders.

In co-pending application Ser. No. 678,439, filed Dec. 5, 1984 and assigned to the assignee of this application, a plurality of cylinders are mounted in a peripherally spaced array about the axis of a power output shaft, but the support structure for the cylinders is rigidly secured to one of the bearing supports for the shaft. The cooperating piston elements are again connected to a rotatable element of a unidirectional (over-running) clutch mounted on the shaft and impart a periodic rotation to the power output shaft through the unidirectional (over-running) clutch, but can move back to their positions relative to the cooperating cylinders free of any connection to the rotating power output shaft.

In both of these prior art constructions, the open inner ends of the peripherally spaced array of cylinders communicate with a fluid pressure chamber within which a small pressure is maintained, sufficient to return the piston (or the cylinders), as the case may be, to their power stroke initiating positions wherein the pistons are disposed adjacent the outer closed end of the cylinders, ready to receive another charge of pressured gas. This necessarily involves a slight loss in mechanical efficiency of the expander due to the mechanical effort required to return the relatively light weight pistons to their power stroke initiating positions in the cylinders. If the pistons can be rapidly returned to their power stroke initiating positions relative to the cylinders while developing a useful mechanical output, obviously, the overall efficiency of the expander can be improved.

SUMMARY OF THE INVENTION

This invention provides a peripherally spaced array of pairs of cylinders disposed about the axis of a stationary shaft. Each cylinder has a closed end and an open end and each pair is disposed in the array in radially spaced relationship with respect to the axis of the stationary shaft and with the open ends of the cylinders in opposed relationship. A piston is provided to cooperate with each cylinder and connecting rods are provided for each piston which extend through the open ends of the cylinders. The projecting ends of the connecting rods are in turn pivotally secured to the outer rotary element of a conventional unidirectional (over-running) clutch which is mounted for unidirectional rotation about an inner element which is secured to the stationary shaft.

A cylinder support structure is mounted for rotation about the stationary shaft and is connected to the outer rotary element of a second conventional unidirectional (over-running) clutch which has its inner element secured to the stationary shaft.

Load driving members such as pulleys or gears are then respectively secured to the rotatable outer elements of both unidirectional (over-running) clutches.

A charge of pressured gas is supplied to the closed outer ends of each of the cylinders as the respective piston aporoaches such closed end. This charge of gas is effective to drive the piston toward the open end of the respective cylinder and, if this direction of linear movement of the piston is compatible with the rotational freedom of the outer clutch element to which it is secured, the outer clutch element of the first unidirectional (over-running) clutch, and hence the load driving member secured to such outer clutch element is rotated through an arc corresponding to the stroke of the pistons.

Because the pistons are mutually interconnected, when one of the pistons in the pair of cylinders moves towards the inner end of its respective cylinder, the other piston necessarily moves toward the closed outer end of the other cylinder. As this last mentioned piston approaches such closed end, an inlet valve mechanism is actuated to introduce a charge of pressured gas into the second cylinder, and this pressured gas effects a return motion of the pistons relative to their respective cylinders. The pistons are, however, prevented from moving during such return motion by the action of the first mentioned unidirectional (over-running) clutch, so that the cylinder is actually rotated by the reaction force created by the pressured gas which acts against the cylinder head, to effect the relative return motion of the other piston to the outer end of the other cylinder. Such angular rotation of the cylinder support structure is permitted by the second unidirectional (overrunning) clutch and hence produces an angular rotation of the load driving member that is connected to the rotatable element of the second unidirectional (over-running) clutch. The direction of rotation of the second load driving member is the same as that of the first load driving member, but the two power outputs are entirely independent.

In the event that it is desired to combine the two mechanical power outputs produced by the aforedescribed expander/prime mover, the two rotatable load driving members can be connected to the two input shafts of a conventional differential gearing mechanism having a single output shaft. In this manner, a single rotating power output can be obtained from the two independent mechanical outputs of the expander/prime mover.

As each charge of gas is expanded in each cylinder, it is obviously cooled and the cooled gas may be utilized for air conditioning or air cooling purposes in a manner described in detail in the hereindescribed co-pending patent applications.

In an embodiment of this invention, the two co-acting cylinders comprising the aforementioned pair of cylinders, may be conveniently fabricated from a single tubular body having end caps secured to each end in which the inlet and exhaust valves are mounted. The effective open ends of the two cylinders are provided by an elongated slot formed in the medial portions of the tubular body. A pair of pistons are respectively mounted in each end of the tubular body and have connecting rods which are pivotally interconnected. A link extends through the elongated slot in the tubular body and at one end is pivotally connected to the ends of the connecting rods. The other end of the link is rigidly secured to the rotatable outer element of the conventional unidirectional (over-running) clutch. Thus, a single set of mounting brackets may be employed to mount both of the cylinders in position and the cost of manufacturing and assembling the two cylinders of the cooperating pair of cylinders is significantly reduced.

Further objects and advantages of the invention will be readily apparent to those skilled in the art from the following detailed description, taken in conjunction with the annexed sheets of drawings, on which is shown several preferred embodiments of the invention.

DESCRIPTION OF PREFERRED EMBODIMENT

Figure 1:
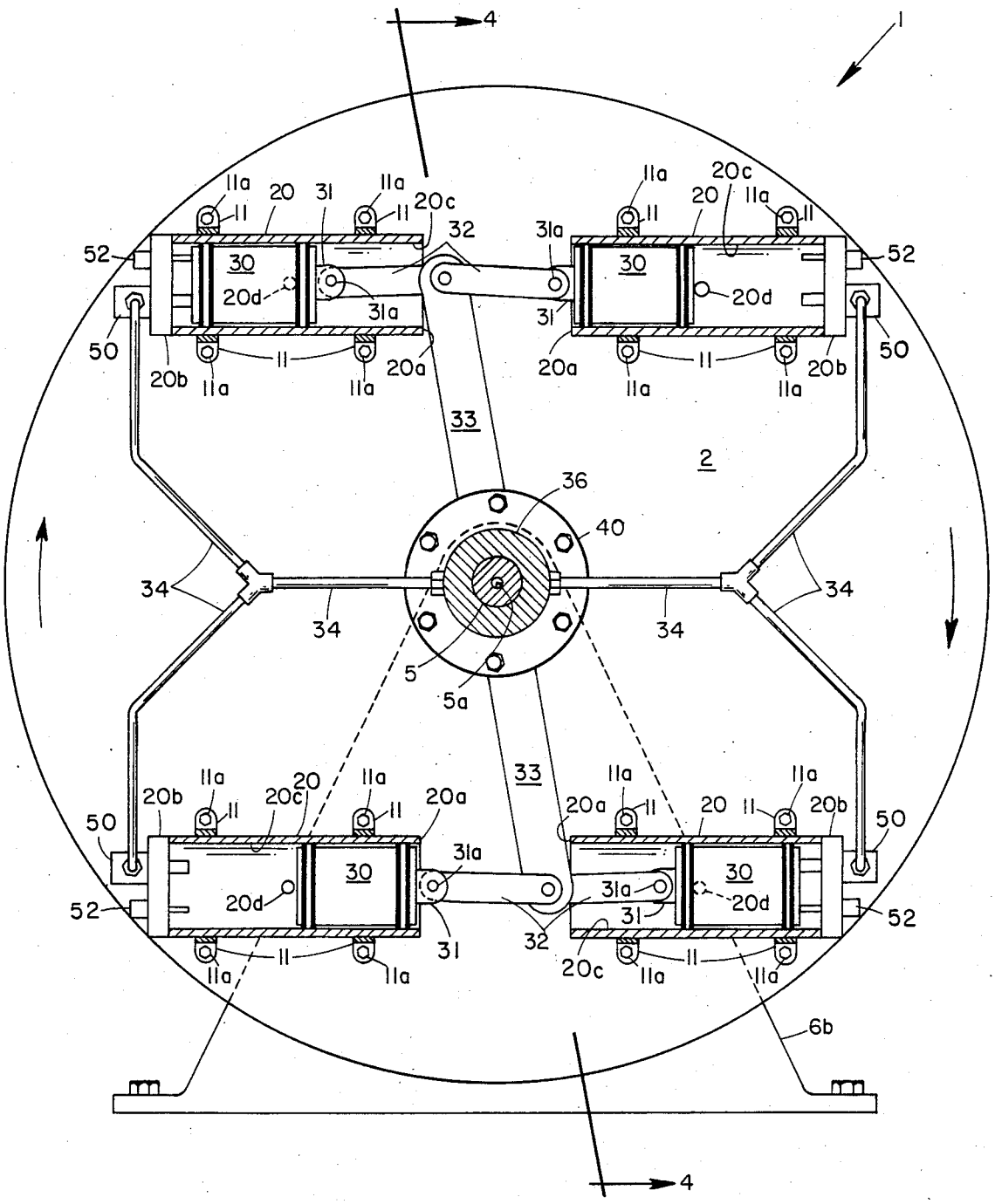
FIG. 1 is a schematic front elevational view, partly in section, of an expander device utilizing a peripherally spaced array of pairs of cylinders, with the cooperating pistons shown in one extreme position.

Referring to FIGS. 1–4, there is schematically shown a piston type expander 1 embodying this invention. Expander 1 incorporates a cylinder support frame 2 which may conveniently take the form of a cylindrical disc which is mounted for rotation about the axis of a stationary shaft 5 in a manner to be later explained. Shaft 5 is supported at each of its ends and secured against rotation by a pair of upstanding bearing pillars 6*a* and 6*b*. Keys 6*c* may be employed to retain the shaft 5 against rotation with respect to the bearing pillars 6*a* and 6*b*.

A plurality of pairs of cylinders 20 are mounted in peripherally spaced relationship about the axis of the shaft 5 by a plurality of clamps 11 and bolts 11*a* which are secured to the cylinder supoort disc 2. Each cylinder 20 has an open end 20*a* and a closed end 20*b*. Each pair of cylinders 20 are disposed with their open ends in spaced, opposed relationship.

Within the bore 20*c* of each cylinder 20, a conventional piston 30 is mounted in slidable and sealing relationship. Each piston 30 is provided with a pivot lug 31 by which the respective piston is pivotally connected to a connecting rod 32 by a pivot pin 31*a*. The other ends of connecting rods 32 extend thru the open cylinder ends 20*a* and are in turn pivotally connected to lever arms 33 which are rigidly secured to one rotatable element 40*a* (FIG. 4) of a conventional unidirectional (over-running) clutch 40 as by bolts 33*a*. The other element 40*b* of such clutch is keyed to stationary shaft 5.

Figure 5A:
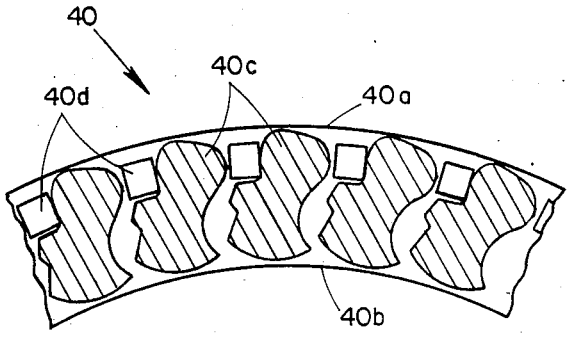
FIGS. 5*a* and 5*b* are enlarged scale schematic views illustrating the construction and operation of the conventional unidirectional (over-running) clutches employed in the modifications of FIGS. 1–4.
Figure 5B:
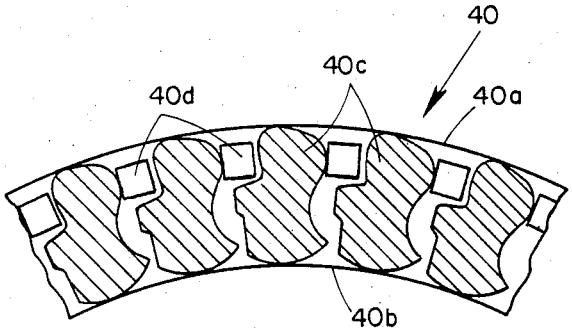

While the unidirectional (over-running) clutch 40 may comprise any one of a variety of types available in the market, I preferably employ an over-running clutch with PCE sprags as sold by DANA CORPORATION under the trademark "FORMSPRAG". As schematically illustrated in FIGS. 5A and 5B, such unidirectional (over-running) clutch incorporates an inner element 40*b* which is suitably keyed to the stationary shaft 5 and is unidirectionally rotationally connectable to the outer clutch element 40*a* by a plurality of peripherally spaced sprags 40*c*. Sprags 40*c* are respectively rockable about their own axes by actuating bars 40*d* which are secured to the outer rotatable clutch element 40*a*. Movement of the outer rotational clutch element 40*a* in a clockwise direction relative to the inner stationary clutch element 40*b* results in a freewheeling or over-running condition, (FIG. 5A) thus permitting the outer clutch element 40*a* to rotate relative to the stationary inner clutch element 40*b*. Any tendency, however, for the outer clutch element 40*a* to move in a counterclockwise direction relative to the inner clutch element 40*b* results in a shifting of the sprags to a locking or engaged condition (FIG. 5B) preventing counterclockwise movement of the outer clutch element 40*a* and thus preventing movement of the pistons 30 in such direction.

Accordingly, when a load driving element 35, such as a pulley or gear 35 is bolted to a hub 36, which in turn is bolted to the outer clutch element 40*a*, it will be rotated through an angular distance determined by the stroke of one-half of the pistons 30 which are moved through the application of pressured gas to the closed ends 20*a* of the cylinders 20 to which half of the pistons 30 are adjacent. Thus, the upper left piston 30 and the lower right piston 30 shown in FIG. 1 would be simultaneously shifted relative to the respective cylinders 20 to impart a clockwise angular rotational stroke to the load output element 35. As the driving pistons 30 approach the end of their stroke, they respectively uncover exhaust ports 20*d* provided in the walls of each cylinder 20. Thus, the initial charges of pressured gas are discharged through such exhaust ports and the gas will be in an expanded and cooled condition relative to the pressure and temperature of the pressured gas when such charge was introduced into the respective cylinders 20. The pistons 30 are then in the positions shown in FIG. 2.

Figure 2:
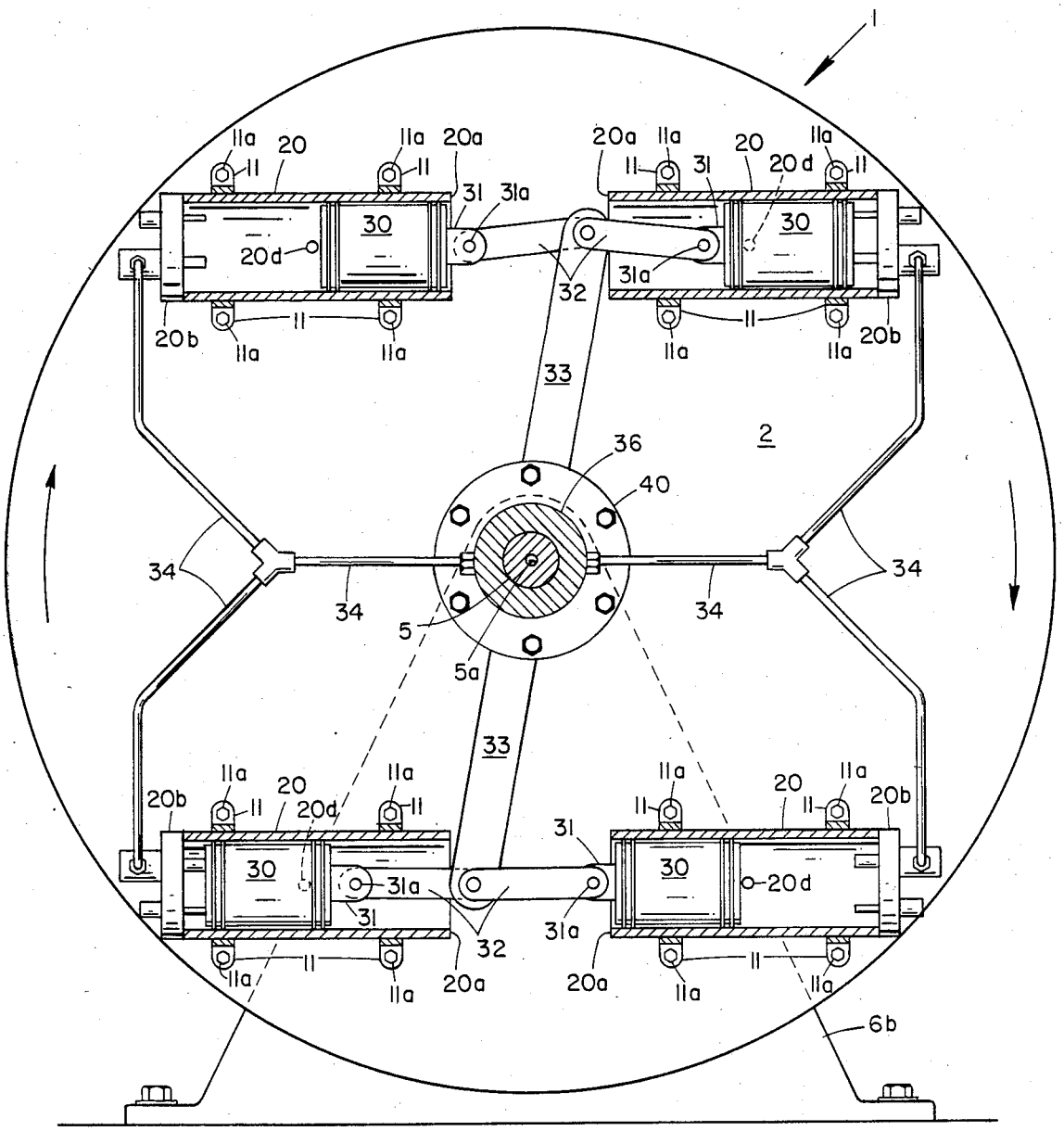
FIG. 2 is a view similar to FIG. 1, but with the pistons moved to their other extreme position.

To effect the return of the pistons 30 to their initial positions, the cylinders 20 are advanced in the same direction as the rotation of the load driving output member 35. As previously mentioned, the cylinder support disc 2 is rotatably mounted relative to the stationary shaft 5, but such rotational mounting is accomplished through a second unidirectional (over-running) clutch element 45. The central portions of the cylinder support disc 2 are secured by suitable bolts 2*a* to the outer rotational element 45*a* of the unidirectional (over-running) clutch 45. The inner clutch element 45*b* is keyed to the stationary shaft 5. Unidirectional rotation of the output clutch element 45*a* with respect to the inner clutch element 45*b* is permitted by the plurality of sprags 45*c* in the same manner as previously described and illustrated in FIG. 5. Thus, when the upper left and the lower right pistons 30, as shown in FIG. 2, have completed their power stroke and uncovered the respective discharge ports 20*d*, the opposed pistons respectively actuate an inlet valve mechanism 50 which is contained within the adjacent closed end 20*b* of each cylinder 20. Such inlet valve mechanism functions to not only cushion and stop the motion of the said pistons 30 toward the respective closed end of cylinders 20 but also to introduce new charges of gas which will respectively operate on the pistons 30 shown in the upper right and lower left portions of FIG. 2. Since the pistons 30 cannot move backwards due to the action of unidirectional (over-running) clutch 40, the reaction force of the charges of pressured gas introduced into the upper right and lower left cylinders 20 will function to impart a driving rotational force to the cylinders 20, which will rotate the cylinder support disc 2 in the same direction as the load driving member 35. A second load driving member may then be rigidly connected to either the cylinder support 2 or the outer unidirectional (over-running) clutch element 45*a*, such as the pulley 45, and it will produce a mechanical load output in the same direction as the load output pullet 35, but the two load output elements 35 and 45 will be operating completely independently of each other.

The introduction of a pressured charge of gas into each cylinder as the respective piston approaches its closed end is accomplished by inlet control valves 50 and exhaust valves 52 which are respectively mounted in each closed end 20*b* of each cylinder. These valve elements are only shown schematically since their construction and operation are described in detail in the aforementioned pending applications and co-pending application Ser. No. 617,288, filed June 4, 1984 and assigned to the assignee of this application, and such description is incorporated herein by reference. In each case, as a piston 30 approaches the closed end 20*b* of the respective cylinder 20, the exhaust valve 52 is maintained in an open position until the piston 30 is almost at the end of its stroke, whereupon the exhaust valve 52 closes and provides a trapped cushion of gas to arrest the movement of the pistons. The inlet valve 50 then functions to introduce a charge of pressured gas to the closed end of the cylinder 20 to impart a driving force to the respective piston 30.

Figure 3:
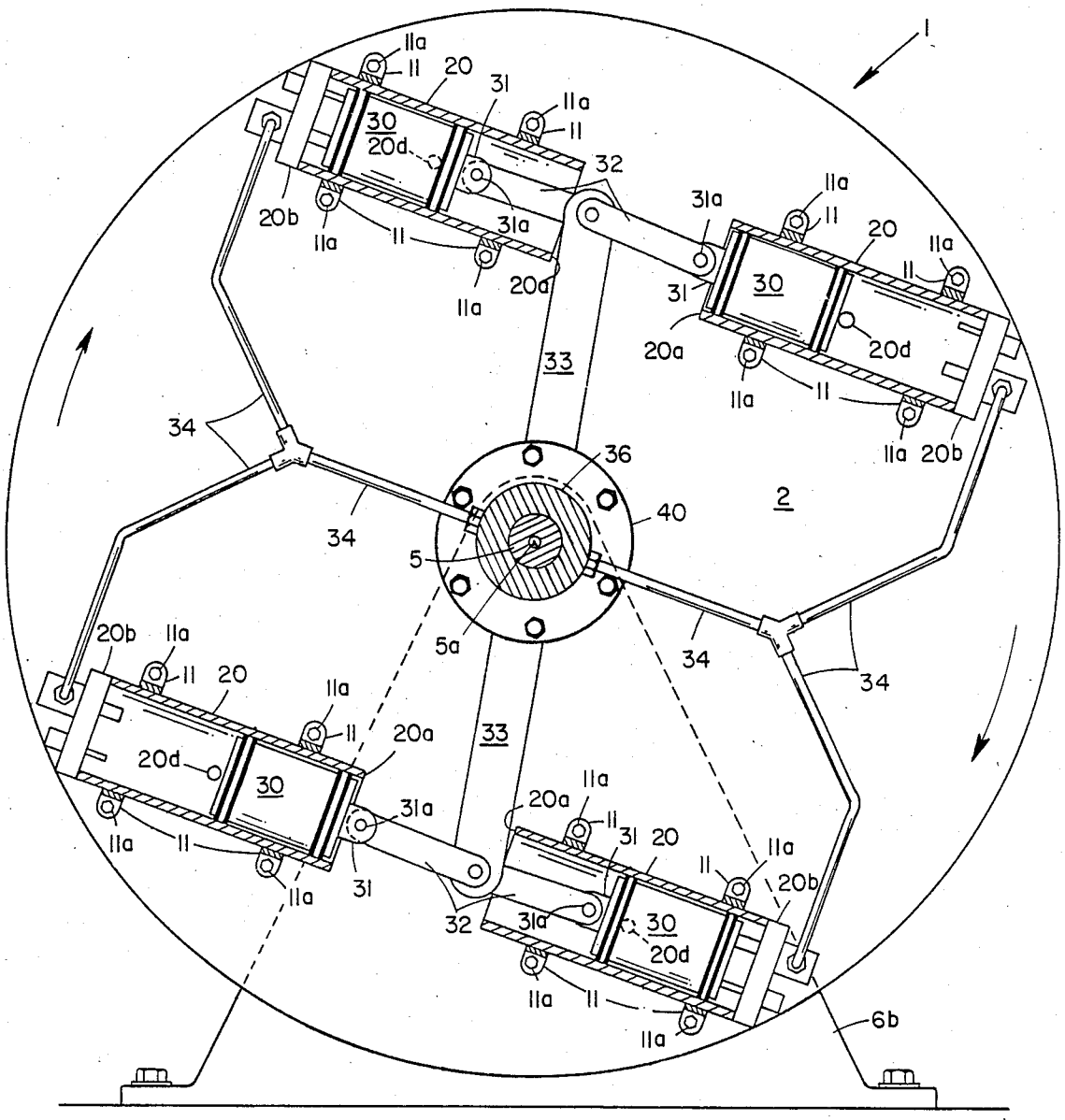
FIG. 3 is a view similar to FIG. 2 but with the cylinders moved to return the pistons to their starting positions relative to the cylinders.
Figure 4:
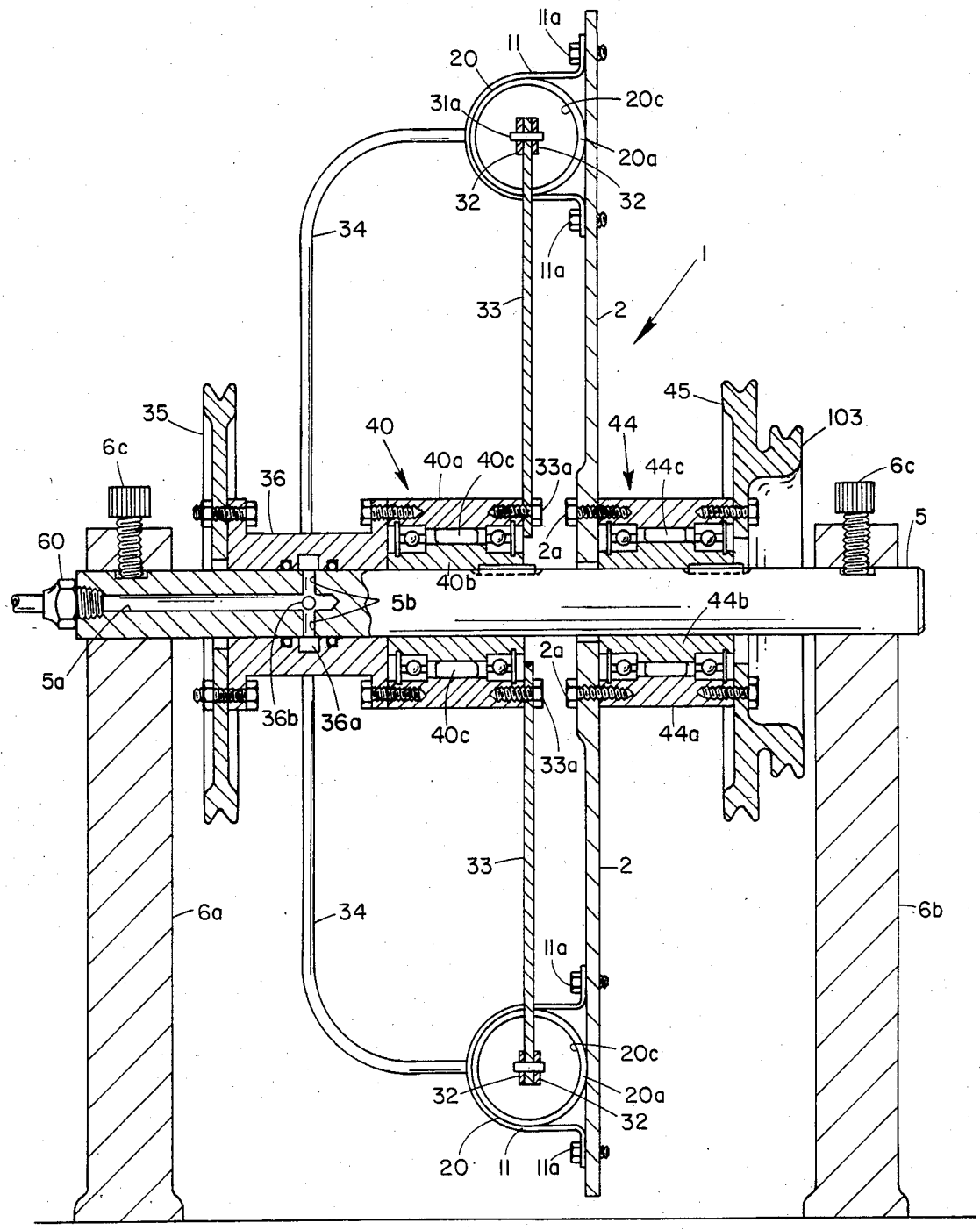
FIG. 4 is a vertical sectional view of FIG. 1.

The cylinders 20 and pistons 30 then assume the positions shown in FIG. 3. Since cylinder support disc 2 is intermittently angularly advancing, ordinary hoses or pipes cannot be employed to supply pressured fluid to the cylinders 20. The pressured fluid is therefore supplied through a hose connection 60 which communicates with a hollow bore portion 5*a* of stationary shaft 5. At the inner end of the hollow bore 5*a*, radial ports 5*b* are provided which communicate with an annular channel 36*a* formed in pulley hub 36. Suitable seals are provided on each side of channel 36*a*. Radial ports (not shown) are respectively provided in communication with annular channel 36*a* and connected by hoses 34 to the inlet valves 50 of each of the cylinders 20. Thus, a supply of pressured gas is constantly available at each inlet valve 50 and the gas is admitted to the respective cylinder only after the respective piston approaches the closed end of the cylinder to actuate the inlet valve 50 in the manner described in the aforementioned pending applications.

Figure 6:
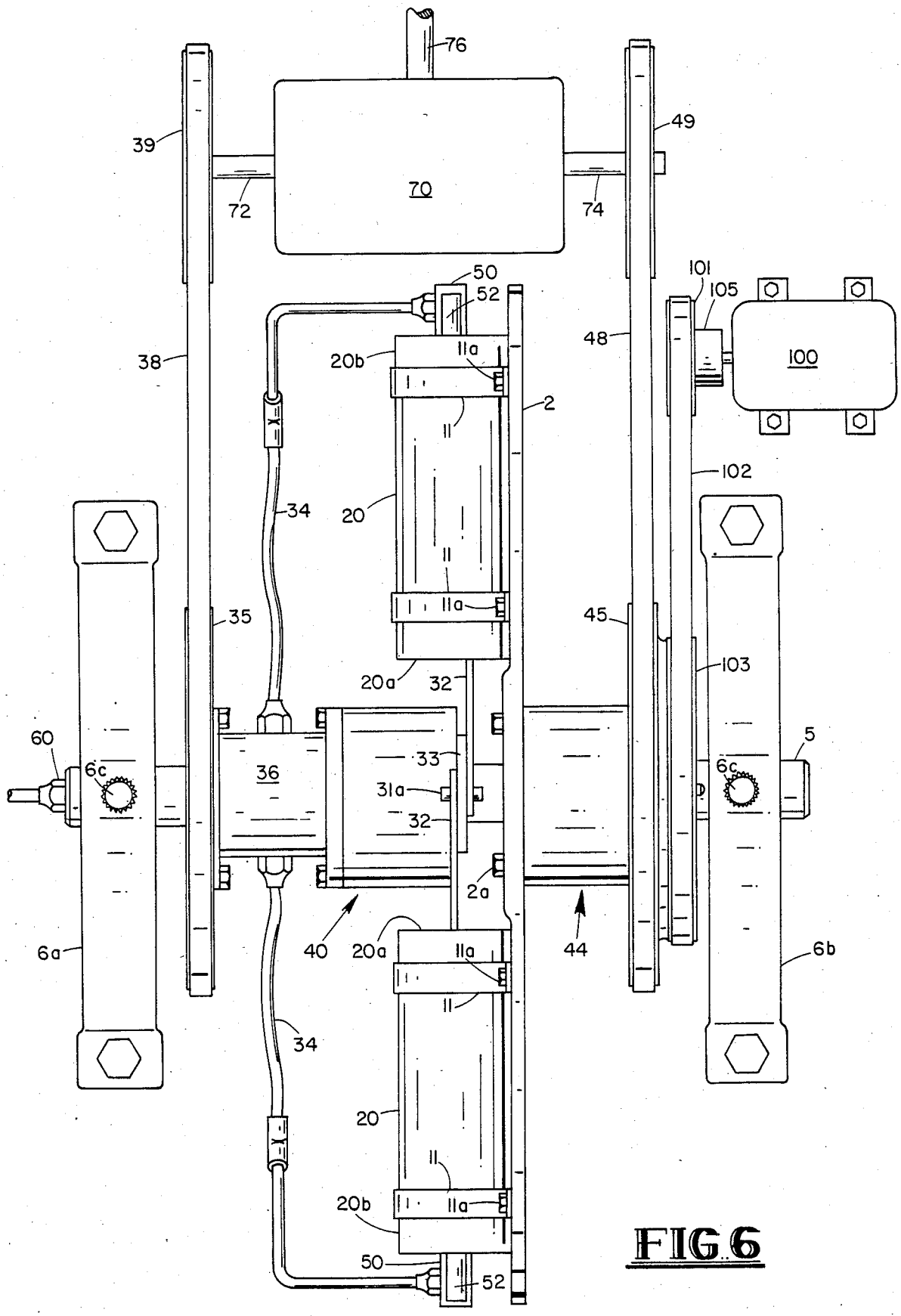
FIG. 6 is a schematic view illustrating one apparatus for effecting the combination of the dual mechanical outputs of the expander embodying this invention into a single rotary mechanical output.

Referring now to FIG. 6, there is shown a mechanism for mechanically interconnecting the two mechanical outputs derived from the expander/prime mover 1 in order to drive a single power shaft 76. The output pulleys 35 and 45 are connected by belts 38 and 48 to a pair of pulleys 39 and 49 which are respectively mounted on the input shafts 72 and 74 of a conventional differential gear box 70. Power shaft 76 constitutes the output shaft of the differential gear box 70 and is driven in a continuous rotation mode. The speed of the power output shaft 70 will of course be determined by the load to which it is connected but it will be recognized that it receives successive pulses of rotary input power from the load driving elements 35 and 45 of expander/prime mover 1.

Alternatively, a single power output shaft (not shown) could be connected to the output pulleys 39 and 49 respectively by a pair of conventional overrunning clutches with the same results that the single power output shaft receives successive pulses of rotary input power from the load driving elements 35 and 45 of expander 1.

FIG. 6 also shows schematically a mechanism for effecting the starting of the expander/prime mover 1. This comprises a battery driven motor 100 having a unidirectional (over-running) clutch 105 driving an output pulley 101 connected by a belt 102 to a pulley 103 which is suitably secured to one of the rotational load driving elements of the expander/prime mover 1. In the illustrated example, it is shown as being an integral part of the load driving element 35. It is only necessary to energize the starting motor 100 for a period of time sufficient to move two of the piston elements 30 to their positions adjacent closed ends 20*b* of the respective cylinders, thus tripping the respective inlet valves 50 and causing a power stroke of the two pistons to be initiated.

Alternatively, the mechanism can be started by manually shifting either one of the rotational power output elements until two of the pistons are moved to their positions adjacent the closed end of the respective cylinders. While the pistons and cylinders are held in this position, pressured gas is applied to the inlet valves 50 which have been opened by the manually produced movement of the pistons 30, and the charge of pressured gas will drive two of the pistons toward the open ends of the respective cylinders and initiate the operation of the expander/prime mover 1.

It will therefore be apparent that this invention provides a piston type expander/prime mover with the unusual properties of utilizing two interconnected pistons, respectively mounted in two opposed cylinder units so that one piston is always being driven by a charge of pressured gas while the other piston is being returned to its starting position with respect to its cylinder. Moreover, in contrast to the disclosures of the aforementioned co-pending applications, a separate source of fluid pressure is not required to effect the return of the pistons to their starting positions with respect to the respective cylinders. Moreover, two entirely independent mechanical rotational outputs can be obtained from the expander embodying the method and apparatus of this invention.

A further unique advantage of the method and apparatus of this invention is the fact that the power normally consumed in absorbing the inertia energy of the piston at the end of its power stroke is not wasted but is translated into a fluid pressure force which operates on the closed end wall **20*b* of the respective cylinder 20** to initiate movement of the cylinders in the same direction as the pistons are driven on their power stroke. This feature substantially improves the overall efficiency of the apparatus in converting the energy of the gas into useful mechanical output.

Figure 7:
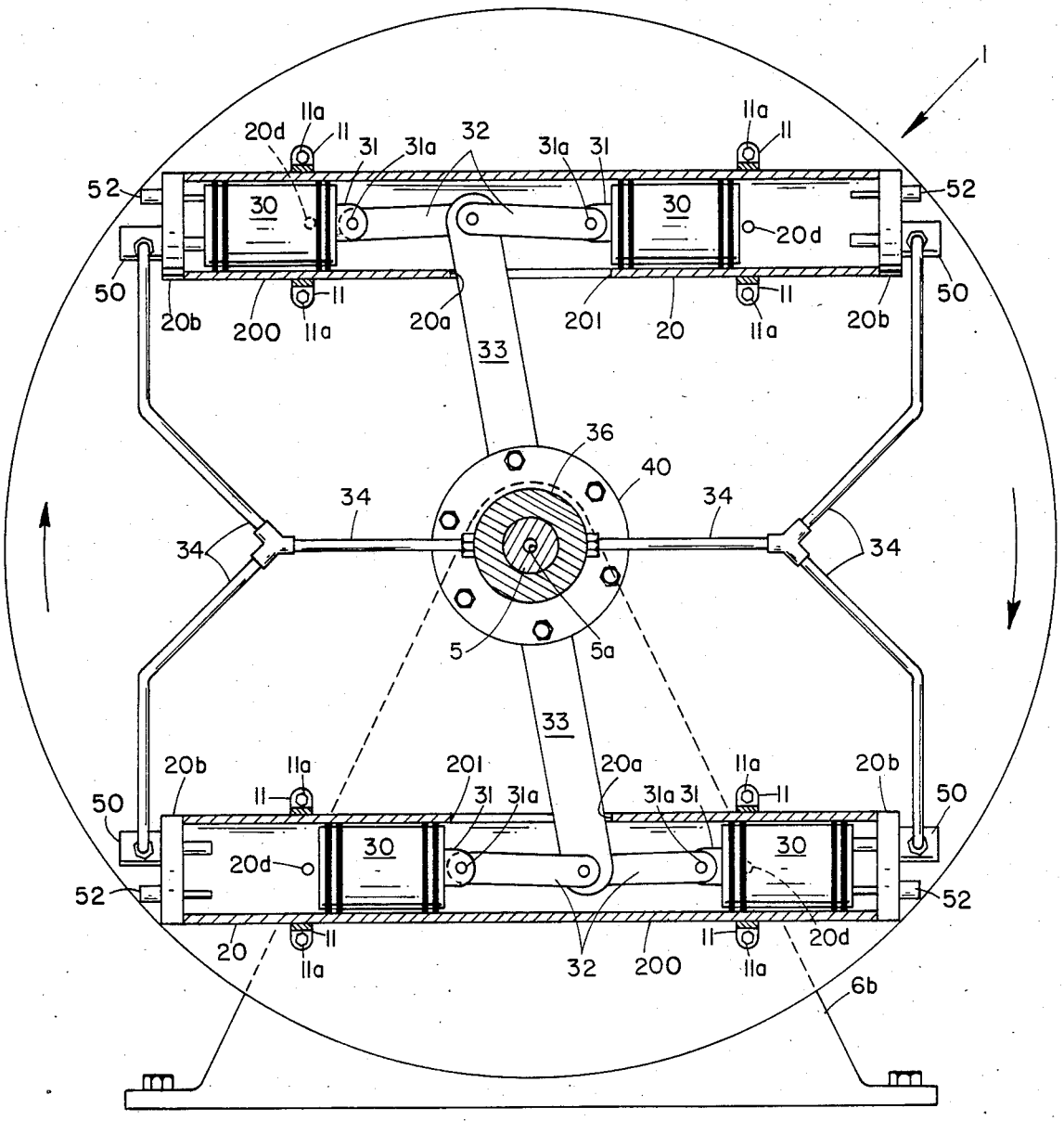
FIG. 7 is a schematic front elevational view, partly in section, of an expander utilizing a modified cylinder construction.

Referring now to FIG. 7, there is shown a modified construction of the opposed pairs of cylinders utilized in expander 1. Similar numerals in FIG. 7 indicate parts identical to those described in the modification of FIGS. 1–5 and these parts will not be again described.

The pair of cylinders is now defined by a single tubular element 200 having a bore within the opposite ends of which a pair of pistons 30 are respectively mounted in sliding and sealing relationship. Instead of having a completely opened end **20*a* as in the modification of FIGS. 1–5, the tubular body 200 is provided with an elongated slot 201 in its medial portion through which the lever connection 33 to the rotatable unidirectional (over-running) clutch element 40*b* extends. Otherwise, the operation of the cylinders, the pistons 30** and the input and exhaust valves is identical to that previously described.

The fabrication of the two cylinders as a unitary tubular element simplifies the manufacture of such cylinders and the assembly of the opposed pairs of cylinders on the cylinder support disc 2.

While for the purposes of simplicity of description, the expander 1 has been described as having only two pairs of cylinders, it is obvious that any desired number of pairs of cylinders may be employed dependent only on the space limitations for mounting such cylinders on the cylinder support element 2. Thus, 3 or more pairs of cylinders may be employed if the particular load application requires this additional power.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

I claim:

1. A pressured gas expander comprising: a stationary shaft; a pair of unidirectional clutches mounted on said stationary shaft in axially spaced relationship; each said unidirectional clutch having a first ring member mounted on and secured to said stationary shaft and a second ring member mountd adjacent to said first ring member and rotatable only in one direction relative to said first ring member; a cylinder support secured to said second ring member of one said unidirectional clutch for rotation about said stationary shaft; a pair of cylinders; each said cylinder having a closed end and an open end, means for mounting said pair of cylinders on said cylinder support in radially spaced relation to the axis of said stationary shaft and with said open ends in opposed relation; a piston linearly movable in each said cylinder, a connecting rod pivotally secured to each piston and projecting through the open end of the respective cylinder; means for pivotally connecting the projecting ends of said connecting rods to the second ring member of the other said unidirectional clutch; an inlet valve in each said closed cylinder end operable by the respective piston for supplying pressured gas to each closed end of said cylinders only when the respective piston approaches said closed end; and load driving means mounted on each said second ring member, whereby two separate loads may be independently rotated at different speeds by the expander.

2. The method of extracting head and mechanical energy from a pressured gas comprising the steps of:

(1) mounting a pair of unidirectional clutches on a stationary shaft in adjacent relationship each clutch having a unidirectionally rotatable element surrounding axially spaced portions of said stationary shaft;

(2) mounting a pair of cylinders, each having an open and a closed end, for rotation about said shaft axis in radially spaced relationship thereto and with said open ends in opposed relationship;

(3) connecting the cylinders to the unidirectional rotating element of one of said unidirectional clutches;

(4) inserting pistons in each said cylinder and connecting each piston by a linkage to the unidirectionaly rotating element of the other unidirectional clutch;

(5) operating a pressured fluid inlet valve by each said piston to introduce a charge of pressured gas in the closed end of each cylinder only when the respective piston approaches such closed cylinder end;

(6) exhausting the expanded cooled gas charge as each piston approaches the open end of the respective cylinder; and, (7) connecting said unidirectional rotatable elements of said unidirectional clutches to separate mechanical loads.

* * * * *

UNITED STATES PATENT OFFICE
CERTIFICATE OF CORRECTION

PATENT NO. : 4,658,703
DATED : April 21, 1987
INVENTOR(S) : David R. Greene

It is certified that error appears in the above-identified patent and that said Letters Patent are hereby corrected as shown below:

Column 8, line 38, delete "head" and substitute --heat--.

Signed and Sealed this

Eighteenth Day of August, 1987

*Attest:*

DONALD J. QUIGG

*Attesting Officer*

*Commissioner of Patents and Trademarks*